United States Patent [19]

Kocay et al.

[11] 3,951,182

[45] *Apr. 20, 1976

[54] LOW-MOISTURE REGAIN MEAT SHROUDS

[75] Inventors: Witold R. Kocay, Creve Coeur, Mo.; James B. Denmark, Decatur, Ala.

[73] Assignee: Monsanto Company, Decatur, Ala.

[ * ] Notice: The portion of the term of this patent subsequent to May 6, 1992, has been disclaimed.

[22] Filed: Feb. 24, 1975

[21] Appl. No.: 552,572

Related U.S. Application Data

[63] Continuation-in-part of Ser. No. 400,870, Sept. 26, 1973, Pat. No. 3,881,525.

[52] U.S. Cl. ..... 139/420 R; 426/410

[51] Int. Cl.[2] ..... D03D 15/00

[58] Field of Search ..... 139/383, 384 R, 387, 139/389, 420, 426; 99/174; 426/410, 323, 420, 520

[56] References Cited

UNITED STATES PATENTS 3,881,525 5/1975 Kocay et al. ..... 139/420 R

*Primary Examiner*—James Kee Chi

*Attorney, Agent, or Firm*—Thomas Y. Awalt, Jr.

[57] ABSTRACT

Meat shrouds comprised of inherently low moisture regain filament provide non-shedding durable meat shrouds suitable for conditioning meat carcasses without excessive dehydration.

13 Claims, 2 Drawing Figures

LOW-MOISTURE REGAIN MEAT SHROUDS

This is a continuation-in-part application of our Ser. No. 400,870, filed Sept. 26, 1973, now U.S. Pat. No. 3,881,525.

BACKGROUND OF THE INVENTION

1. Field of the Invention

This invention relates to the conditioning of animal carcasses after slaughtering and skinning. The carcasses, with a smooth, bleached surface, are shrouded and placed in a cool atmosphere and the carcass temperature is lowered to about the freezing temperature.

Traditionally, meat shrouds were constructed of high moisture regain fabrics because these fabrics were initially and exclusively available, and because they were found satisfactory for conditioning carcasses in the sense that the carcasses could be stored in a reasonably orderly fashion, permitted to breathe without excessive dehydration, all the while presenting a reasonably acceptable appearance both in the shroud and after removal of the shroud. Secondary attributes of the high moisture regain meat shroud were a high degree of blood absorption, smoothing of the surface, maintenance of "bloom" in the meat, and distribution of moisture on the carcass. Disadvantages of these high moisture regain shrouds included the strong odor which lingered on the shroud even after washing, and the short life resulting partially from the fact that most high moisture regain fabrics were not of sufficient durability. The meat industry was lacking in a shroud which would stand hard use and repeated washing and which would, in fact, wash clean. Such a shroud would indeed be a meritorious advance in the art.

2. Description of the Prior Art

Meat shrouds have been produced from cotton, ramie, rayon and polyester staple. Before the introduction of polyester staple in shrouds, generally speaking, moisture regain, wicking, water swelling, water retention, and high wet-modulus were considered essential characteristics to be sought in meat shrouds primarily to prevent the dehydration of meat, but secondarily in order to absorb blood so that the surface of the meat be rendered as bloodfree and as presentable as possible. Moisture retention in the carcass being the primary consideration, standard acceptable moisture absorption percentages in commercial shrouds were of the order of 120–160. percent. Moreover, it was and is considered essential that meat shrouds have high strength and resistance to tear and to soil and stain release as well as stability to withstand chlorine bleaching without serious fiber damage. Meat shrouds are laundered after each use and they must be reasonably clean for reuse. Polyester staple shrouds were recently introduced because polyester is known for excellent durability, and it had been found that fibers of polyethylene terephthalate, although having a generally low moisture regain, wicking action, water retention, etc., could be used in staple form without sacrifice of fabric moisture regain, wicking action, and swelling; and therefore in staple form, at least, low moisture regain fibers could be used in meat shrouds. Staple polyester meat shrouds were thereupon adopted by the industry; but it was found that shrouds constructed of staple polyester fibers had one deficiency inherent in the staple form of fabric, and that is they had a tendency to shed or deposit occasional parts of a fiber on the carcass, especially after having been washed repeatedly.

These individual fibers, usually of a fraction of an inch in length, while of no particular significance from a health and sanitation point of view were more conspicuous than cellulosic fiber deposits, due to accumulation of electrostatic charge on the fibrils, and appeared somewhat more like animal hair which is considered a source of possible contamination originating from animal skin. The industry had, therefore, prior to the present invention no completely satisfactory conditioning shroud which was both apparently and inherently sanitary, durable, and which would foster an acceptable appearance to the carcass both inshrouded and out of the shroud, all the while retaining during the shroud period sufficient moisture to prevent meat dehydration.

SUMMARY OF THE INVENTION

In accordance with the present invention, the disadvantages of the prior art shrouds are avoided and durability is achieved through the use of the more durable low moisture regain fibers in filament form rather than staple form, unforseeably retaining moisture in the carcass without high fabric absorption. As a result, shrouds are easily washed and do not maintain the objectionable odor of the high regain, high wicking shrouds.

It is an advantage of this invention that the new meat shroud does not leave a hair-like deposit on the carcass. It is another advantage of this invention that it has extremely high breaking strength, grab strength, tear strength and skewer strength. It is yet another advantage of this invention that shrouds are provided with good soil and stain release.

BRIEF DESCRIPTION OF THE DRAWING

Reference will be made to the drawing in which.

DESCRIPTION OF THE PREFERRED EMBODIMENTS

In accordance with this invention, meat shrouds are provided, a major portion of which comprise a low moisture regain filament having a denier of from about 4–8, and a tenacity of at least about 4 grams per denier, the fabric being characterized by a skewer strength of at least about 80 pounds (36,288 g), a grab strength of at least about 200 pounds (90,720 g) in both warp and fill direction, a simulated carcass relative moisture retention capability of no less than about 1, and a fabric moisture absorption of no more than about 65 percent. We have discovered, for example, that filament polyester or nylon meat shrouds made in accordance with these specifications can be even more effective than presently used 100% ramie, cotton, or other cellulosic cloth, in preventing the dehydration of whole beef carcasses.

Figure 1:
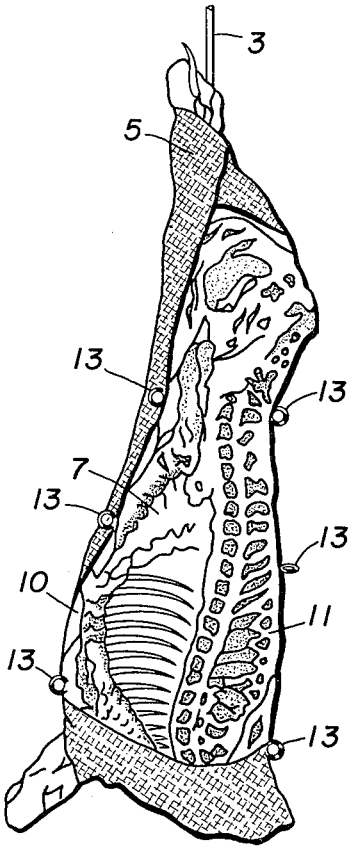
FIGS. 1 and 2 are general perspective views of sides of beef clothed with shrouds.
Figure 2:
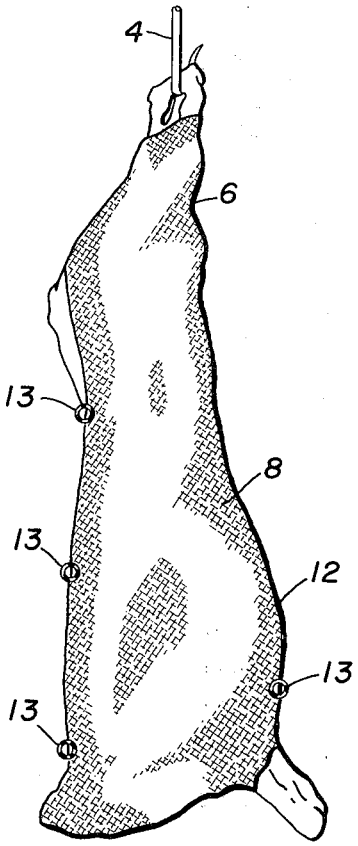

In FIGS. 1 and 2, two sides of beef are shown suspended from conventional hooks 3 and 4. The shrouds 5 and 6 are shown wrapped snugly and smoothly about the skinned surfaces of the carcass. No strings or ties are used at either hindshanks or foreshanks the extremities of which are not covered. The shrouds are secured to the edges 10, 11 and 12 of the visceral cavities 7 and 8 as by skewers 13.

The terms used above are employed in the usual meaning in the textile art except as follows:

"Skewer strength" is a laboratory test designed to measure the units of force required to rupture the fabric when strained by a skewer of similar design to that actually used in a packing plant during the shrouding operation. After wetting, a specimen from the fabric is punctured by the skewer near one end and the opposite end is clamped in the stressing jaw of a tensile tester at a constant rate of extension. The cross-wise yarns are pulled against the skewer until a number have ruptured. The force is recorded automatically on a chart calibrated in convenient units. The average of the individual yarn breaks for each principle direction is reported for the sample. The value obtained is a function of the individual yarn strength plus the support of the adjacent yarns. Calculation of the average force is based on ASTM Standard D-2261 "Tearing Strength of Fabric by Tongue Method (Constant Rate-of-Extension Tensile Testing Machine)." The average of the five highest peaks recorded on the chart is reported. Specimens having filling yarns parallel to the long dimension are used for testing the warp yarns, and specimens with the warp yarns parallel to the long dimension are used for the test of the filling yarns. All specimens are soaked in distilled water for two hours, removed and blotted lightly to remove surface water. The skewer position is determined by means of a 3 (7.62 cm.) square template drilled with a 1/8 in. (0.315 cm.) diameter hole in the center. Using the template, the skewer is positioned 1½ in. (3.81 cm.) from the end of the sample. Before inserting the skewer, a pencil or similar instrument is used to spread the yarns in the form of a hole. The skewer projection is fastened to the upper grip of the tensile tester and the other end of the sample is clamped in the lower grip. The tensile tester is operated with cross-head speed (rate of extension) of 5 in./min. (12.7 cm./min.), a chart speed (recorder) of 10 in./min. (25.4 cm./min.), a load scale of 200 pounds (90,720 g), a jaw separation (between clamps) of 6 in. (15.24 cm.), and with jaw faces (smooth) at 1 in. × 3 in. (2.44 cm. × 7.62 cm.).

The "grab strength" test or "grab" test is a standard method of test for textiles fabrics and is known as ASTM D-1682-64 (Reapproved 1970) of the American National Standards Institute.

By "low-moisture regain" fiber or filament is meant a fiber or filament having an inherent moisture regain of less than about five. Low regain fibers include nylon, acrylic, polyester, and polypropylene, to name but a few. Not all low-moisture regain fibers or filaments are suitable for the production of meat shrouds. Acrylic fibers, for example, are lacking in tenacity.

By "simulated carcass relative moisture retention capability" is meant the relative capability of the shroud to hold the moisture in the carcass, as reflected by the following carborundum stone test. Shroud fabric samples are cut into pieces about 6¾ in. × 8 in. (17.14 cm. × 20.3 cm.). Sixty milliliters of distilled water are absorbed into each of two carborundum stones 6 in. × 2 in. × 1 in. (15.24 cm. × 5.08 cm. × 2.54 cm.). The fabric specimen is wrapped around one of the stones and secured by straight pins. One stone is left unwrapped to use as a control. The stones are hung by a string and weighed; then they are hung in a conditioning chamber at 70° F (38° C) and 50 percent relative humidity for a given period of time. Unless otherwise specified, simulated carcass relative moisture retention, as used herein, reflects a conditioning time of twenty hours. Simulated carcass relative moisture retention capability (MRC) is determined as follows:

$$MRC = \frac{\text{Moisture loss (unwrapped stone)}}{\text{Moisture loss (wrapped stone)}}$$

As used herein the words "major portion" must be construed very broadly because fabrics can be constructed of any percentage of various component fibers or filaments and variations therein will affect the product only in a matter of degree. The examples will show meat shrouds constructed of 100 percent flat yarn filament, of flat and textured polyester filament totalling 100 percent, and of polyester and nylon yarns totalling 100 percent. Of course, combinations of polyester filament and polyester staple as well as polyester filament and other cellulosic and non-cellulosic components including nylon staple or filament, and cotton are also contemplated within the purview of this invention, to the extent that they do not increase the fabric moisture absorption to greater than about 70 percent or otherwise seriously detract from the fabric properties explained above.

By "moisture absorption" or "moisture absorbency" is meant the amount of moisture in terms of weight percent (based on the weight of the fabric) which remains on a 22 cm. × 22 cm. fabric sample after soaking in distilled water at room temperature for 15 minutes, followed by removal from the water and dripping from one corner of the sample for 30 seconds.

EXAMPLES

Meat shrouds were constructed according to the specifications shown in Table 1. Twist employed was only that necessary for yarn handling.

TABLE I

| | | Ex. 1 | Ex. 2 | Ex. 3 | Ex. 4 | Ex. 5 |
|---|---|---|---|---|---|---|
| Warp Filament | Type | PET | PET | PET | PET | Nylon |
| | Denier | 5.2 | 5.2 | 5.2 | 5.2 | 6.0 |
| | Tenacity | 8 | 8 | 8 | 8 | 9.4 |
| | Elongation | 20% | 20% | 20% | 20% | 13% |
| Warp Yarn | Denier | 1000 | 1000 | 1000 | 1000 | 840 |
| | Filaments | 192 | 192 | 192 | 192 | 140 |
| | Texture | no | no | no | no | no |
| Filling Filament | Type | PET | PET | PET | PET | PET |
| | Denier | 5.2 | 4.9 | 4.9 | 5.2 | 5.2 |
| | Tenacity | 8 | 4.2 | 4.2 | 8 | 8 |
| | Elongation | 20% | 34% | 34% | 20% | 20% |
| Filling Yarn | Denier | 1000 | 330 | 660 | 1000 | 1000 |
| | Filaments | 192 | 68 | 136 | 192 | 192 |
| | Texture | no | yes | yes | no | no |
| Fabric Construction | Ends/inch | 31 | 34 | 34 | 30 | 28 |
| | Ends/cm. | 78.7 | 86.4 | 86.4 | 76.2 | 71 |
| | Picks/inch | 26 | 27 | 28 | 25 | 24 |
| | Picks/cm. | 66 | 68.6 | 71.1 | 63.5 | 60.9 |
| | Wt.oz/yd² | 7.7 | 6.16 | 7.23 | 7.9 | 6.7 |
| | Wt.g/m² | 261 | 209 | 245 | 267 | 227 |
| | Weave | plain | plain | plain | plain | plain |
| | Heatset* | no | no | no | yes | yes |

*60 sec. at 390° – 400°F (198° – 206°C)

Testing of the shroud samples of Examples 1–5, as against a commercial cotton shroud is shown at Table II.

TABLE II

| | Ex. 1 | Ex. 2 | Ex. 3 | Ex. 4 | Ex. 5 | Cotton |
|---|---|---|---|---|---|---|
| Grab Strength(lbs.) | | | | | | |
| Warp | 738 | 553.5 | 579.0 | 641 | 602 | 78 |
| Fill | 628 | 126.2 | 262.3 | 552 | 531 | 108 |
| Grab Strength(g) | | | | | | |
| Warp | 334756 | 251067 | 26263 | 290757 | 273067 | 35380 |
| Fill | 284860 | 57244 | 118979 | 250387 | 240861 | 48988 |
| Skewer Strength(lbs.) | | | | | | |
| Warp | 199 | 82.9* | 143.6* | 222 | 227 | 19 |
| Fill | 216 | 43.6* | 71.3* | 167 | 314 | 24 |
| Skewer Strength(g) | | | | | | |
| Warp | 90266 | 37603 | 65137 | 100699 | 102967 | 8618 |
| Fill | 97977 | 19776 | 32341 | 75751 | 142430 | 10886 |
| MRC (16 hr.) | 1.27 | 1.18 | 1.17 | 1.15 | 1.02 | 0.8 |
| MRC (20 hr.) | | 1.59 | 1.59 | 1.19 | 1.04 | 0.82 |
| Absorbency | ±48% | ±48% | ±48% | ±48% | ±58% | ±153% |

*Yarns did not break; they pulled out of fabric

It will be noted that in all of the above described examples, moisture absorbency of the shroud fabrics was inherently low (of the order of 48–58 percent). High filament content fabric blends having a small percentage of high moisture regain component would be expected to run somewhat higher than this. For example, a fabric blend containing 85 percent polyester filament and 15 percent cotton might be expected to have a moisture absorbency of about 70–80 percent.

Having thus described our invention and several embodiments thereof, what we desire to claim and secure by Letters Patent is:

1. Fabric meat shrouds, a major portion of which comprises a continuous filament yarn, a major portion of which comprises a low moisture regain filament, said fibers being otherwise characterized by:

a. a denier of from about 4 to 8;

b. a tenacity of at least about 4 gpd;

said fabric being characterized by:

a. a simulated carcass relative moisture retention capability of not lower than about 1;

b. a skewer strength of at least about 80 lbs. (36,288 g) in at least one direction;

c. a grab strength of at least about 200 lbs. (90,720 g) in both warp and fill direction; and, d. a fabric moisture absorption of no more than about 70 percent.

2. The meat shroud of claim 1 wherein the skewer strength is at least about 150 lbs. (68,040 g) in the warp direction.

3. The meat shroud of claim 1 wherein the skewer strength is at least about 150 lbs. (68,040 g) in the fill direction.

4. The meat shroud of claim 1 wherein the grab strength is at least 250 lbs. (113,400 g) in the warp direction.

5. The meat shroud of claim 1 wherein the grab strength is at least 250 lbs. (113,400 g) in the fill direction.

6. The meat shroud of claim 1 wherein the skewer strength is at least about 199 lbs. (90266 g) in the warp direction.

7. The meat shroud of claim 1 wherein the skewer strength is at least about 216 lbs. (97,977 g) in the fill direction.

8. The meat shroud of claim 1 wherein the grab strength is at least 738 lbs. (334,756 g) in the warp direction.

9. The meat shroud of claim 1 wherein the grab strength is at least 600 lbs. (272,160 g) in the fill direction.

10. The meat shroud of claim 1 wherein the simulated carcass relative moisture retention is at least 1.5, and the fabric moisture absorbency is no more than about 60 percent.

11. The meat shroud of claim 1 wherein the low regain filament is polyester.

12. The meat shroud of claim 1 wherein the low regain filament is nylon.

13. The meat shroud of claim 1 wherein the low regain filament is a mixture of polyester and nylon filament.

* * * * *